US010825640B2

(12) United States Patent
Ishii et al.

(10) Patent No.: US 10,825,640 B2
(45) Date of Patent: Nov. 3, 2020

(54) X-RAY TUBE

(71) Applicant: HAMAMATSU PHOTONICS K.K., Hamamatsu (JP)

(72) Inventors: Atsushi Ishii, Hamamatsu (JP); Tutomu Inazuru, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/380,187

(22) Filed: Apr. 10, 2019

(65) Prior Publication Data

US 2019/0318902 A1 Oct. 17, 2019

(30) Foreign Application Priority Data

Apr. 12, 2018 (JP) ..... 2018-077004

(51) Int. Cl.
*H01J 35/16* (2006.01)
*H01J 35/08* (2006.01)

(52) U.S. Cl.
CPC ..... *H01J 35/16* (2013.01); *H01J 35/112* (2019.05); *H01J 2235/165* (2013.01)

(58) Field of Classification Search
CPC ..... H01J 2235/16; H01J 2235/163; H01J 2235/165; H01J 35/16; H01J 35/165; H01J 35/18; H01J 35/112; H05G 1/06
See application file for complete search history.

(56) References Cited

U.S. PATENT DOCUMENTS 3,567,983 A 3/1971 de Vries
5,077,771 A 12/1991 Skillicorn et al.
5,563,923 A 10/1996 Okada et al.
6,229,876 B1 5/2001 Enck et al.
6,381,305 B1 4/2002 Okada et al.
6,385,294 B2 5/2002 Suzuki et al.
(Continued)

FOREIGN PATENT DOCUMENTS

JP S50-11690 A 2/1975
JP S54-35078 B1 10/1979
(Continued)

OTHER PUBLICATIONS

International Preliminary Report on Patentability dated Apr. 17, 2008 for PCT/JP2006/319872.

*Primary Examiner* — Chih-Cheng Kao

(74) *Attorney, Agent, or Firm* — Faegre Drinker Biddle & Reath LLP

(57) ABSTRACT

An X-ray tube includes an electron gun, a target that generates X-rays, and a vacuum housing that accommodates the electron gun and the target. The vacuum housing has a metal portion having an X-ray emission window, and an insulation valve connected to the metal portion. The metal portion has a cylinder portion in which the X-ray emission window is provided and which surrounds a tube axis of the vacuum housing, and a tapered portion which is connected to an end portion of the cylinder portion, surrounds the tube axis, and protrudes such that a connection part between the metal portion and an insulation valve is covered. The tapered portion has a shape increased in diameter such that a separation distance between a distal end portion and the tube axis is longer than a separation distance between a base end portion and the tube axis.

9 Claims, 7 Drawing Sheets

(56) References Cited

U.S. PATENT DOCUMENTS

| | | | | |
|---|---|---|---|---|
| 6,519,318 | B1 * | 2/2003 | Andrews | H01J 35/12 378/119 |
| 6,526,122 | B2 | 2/2003 | Matsushita et al. | |
| 7,072,439 | B2 | 7/2006 | Radley et al. | |
| 7,085,353 | B2 | 8/2006 | Yoshiyama et al. | |
| 7,340,036 | B2 | 3/2008 | Tomita et al. | |
| 7,466,799 | B2 | 12/2008 | Miller | |
| 7,664,229 | B2 | 2/2010 | Okada et al. | |
| 2005/0163284 | A1 * | 7/2005 | Inazuru | H05G 1/30 378/108 |
| 2009/0238340 | A1 * | 9/2009 | Okada | H01J 35/16 378/140 |
| 2016/0163497 | A1 * | 6/2016 | Greenland | H01J 35/06 378/140 |

FOREIGN PATENT DOCUMENTS

| | | | |
|---|---|---|---|
| JP | 2001-23557 | A | 1/2001 |
| JP | 2003-132826 | A | 5/2003 |
| JP | 2007-59268 | A | 3/2007 |
| JP | 2007-103315 | A | 4/2007 |
| JP | 4954526 | B2 | 6/2012 |
| WO | WO-2004/097888 | A2 | 11/2004 |

* cited by examiner

X-RAY TUBE

TECHNICAL FIELD

An aspect of the present invention relates to an X-ray tube.

BACKGROUND

X-ray tubes are known. An X-ray tube accommodates an electron gun and a target inside a vacuum housing. The electron gun emits electrons. The target receives electrons and generates X-rays. The vacuum housing includes a head portion (metal portion) and a valve portion. The head portion (metal portion) has an X-ray emission window. The valve portion is connected to the head portion and is formed of an insulating member such as a glass. In order to generate X-rays, the X-ray tube applies a high voltage to the target or the electron gun disposed inside the vacuum housing. Therefore, it is important to curb electric discharge occurring inside the vacuum housing. For example, an X-ray tube disclosed in Japanese Patent No. 4954526 has an inner cylinder tube. The inner cylinder tube has a substantially cylindrical shape about a tube axis of the X-ray tube. The inner cylinder tube is provided in a rod-shaped anode disposed along the tube axis of the X-ray tube. The inner cylinder tube hides a joint part between the metal portion and the valve portion. The rod-shaped anode is a member in which a target is fixed to a distal end portion. The inner cylinder tube alleviates a concentration of an electric field generated in the joint part. That is, the inner cylinder tube has a function of curbing electric discharge occurring in the joint part.

However, as in a distal end portion of an inner cylinder portion, an electric field is likely to be concentrated in a protruding part. The inner cylinder tube alleviates a concentration of an electric field generated in the joint part. However, due to a concentration of an electric field in the distal end portion of the inner cylinder tube, electric discharge is likely to occur in the distal end portion. A voltage to be applied for a high output of X-rays is increased. As a result, the potential difference between the distal end portion and a low voltage part (ground potential part) of the vacuum housing increases. A low voltage part is the ground potential part. Therefore, the problem of electric discharge becomes significant.

Therefore, an object of an aspect of the present invention is to provide an X-ray tube capable of effectively curbing electric discharge occurring inside a vacuum housing.

SUMMARY

According to an aspect of the present invention, there is provided an X-ray tube including an electron gun that emits electrons, a target that generates X-rays when electrons emitted from the electron gun are incident on the target, and a vacuum housing that accommodates the electron gun and the target. The vacuum housing has a metal portion which has an X-ray emission window emitting X-rays to the outside and a valve portion which is formed of an insulating material and is connected to the metal portion. The metal portion has a first part in which the X-ray emission window is provided and which surrounds a central axis of the vacuum housing, and a second part which is connected to an end portion of the first part on the valve portion side, surrounds the central axis, and protrudes such that a connection part between the metal portion and the valve portion is covered. The second part has a shape increased in diameter such that a separation distance between a distal end portion on a side opposite to a base end portion connected to the first part and the central axis is longer than a separation distance between the base end portion and the central axis.

DETAILED DESCRIPTION

Figure 1:
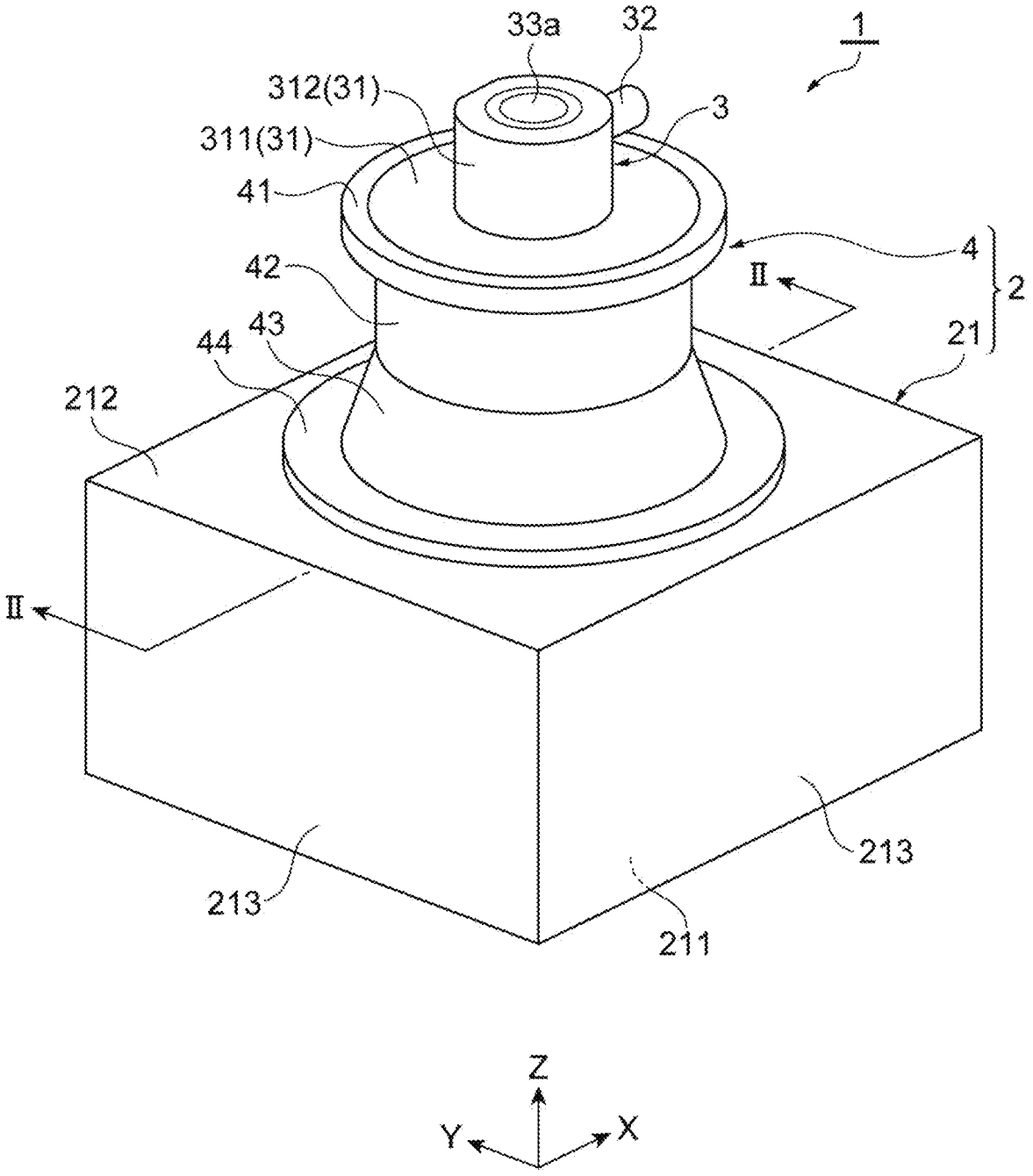
FIG. 1 is a perspective view illustrating the appearance of an X-ray generation device of an embodiment.

According to an aspect of the present invention, there is provided an X-ray tube including an electron gun that emits electrons, a target that generates X-rays when electrons emitted from the electron gun are incident on the target, and a vacuum housing that accommodates the electron gun and the target. The vacuum housing has a metal portion which has an X-ray emission window emitting X-rays to the outside and a valve portion which is formed of an insulating material and is connected to the metal portion. The metal portion has a first part in which the X-ray emission window is provided and which surrounds a central axis of the vacuum housing, and a second part which is connected to an end portion of the first part on the valve portion side, surrounds the central axis, and protrudes such that a connection part between the metal portion and the valve portion is covered. The second part has a shape increased in diameter such that a separation distance between a distal end portion on a side opposite to a base end portion connected to the first part and the central axis is longer than a separation distance between the base end portion and the central axis.

In the X-ray tube according to the aspect of the present invention, due to the second part which protrudes such that the connection part between the metal portion and the valve portion is covered, electric discharge occurring in the connection part is curbed. The connection part is a boundary between a metal and an insulator. Electric discharge is likely to occur in the connection part. Moreover, the distal end portion of the second part has a shape increased in diameter such that the distal end portion is farther from the central axis of the X-ray tube than the base end portion. The distal end portion is an end portion on the first part side. According to this structure, in an X-ray tube employing a diameter increasing shape, the distal end portion of the second part can be away from a member disposed in the central axis of the X-ray tube, compared to the case of employing no diameter increasing shape. A member disposed in the central axis of the X-ray tube is a member having an electrical polarity opposite to that of the metal portion. As a result, a concentration of an electric field generated in the distal end portion is alleviated. Therefore, electric discharge occurring in the distal end portion can be curbed. As described above, according to the X-ray tube, electric discharge occurring inside the vacuum housing can be effectively curbed.

The second part may have a protrusion portion which has the distal end portion and of which the entirety protrudes into an inner space of the vacuum housing, and a base portion which has the base end portion and of which at least a part of an outer surface is exposed to the outside. Inner wall surfaces of the protrusion portion and the base portion may be increased in diameter such that the separation distance between the distal end portion and the central axis is longer than the separation distance between the base end portion and the central axis. According to this structure, an angle formed by the inner wall surface of the first part and the inner wall surface of the second part becomes moderate. Therefore, it is possible to reduce a possibility of electric discharge which may occur in a connection portion between the first part and the second part.

An inner wall surface of the second part may have a tapered shape in which a separation distance between the inner wall surface and the central axis increases linearly from the base end portion toward the distal end portion. In addition, an inner wall surface of the second part may have a curved shape in which a separation distance between the inner wall surface and the central axis increases continuously from the base end portion toward the distal end portion. In addition, an inner wall surface of the second part may have a stepped shape in which a separation distance between the inner wall surface and the central axis increases step by step from the base end portion toward the distal end portion. All of the foregoing configurations have a shape relatively easy to be worked. Therefore, it is possible to realize the diameter increasing shape described above.

In foregoing X-ray tube, an anode having the target may be disposed while extending along the central axis. The electron gun may be disposed while extending along the central axis. In all of the foregoing configurations, a concentration of an electric field generated in the distal end portion is alleviated. Therefore, electric discharge occurring between the distal end portion and the anode can be curbed. In addition, electric discharge occurring between the distal end portion and the electron gun can be curbed. The X-ray tube can effectively curb electric discharge occurring inside the vacuum housing.

According to the aspect of the present invention, it is possible to provide the X-ray tube capable of effectively curbing electric discharge occurring inside the vacuum housing.

Hereinafter, an embodiment of the present invention will be described in detail with reference to the drawings. The same reference signs are applied to parts which are the same or corresponding, and duplicated description will be omitted. In addition, terms indicating predetermined directions such as "up" and "down" are used for the sake of convenience based on the states illustrated in the drawings.

Figure 2:
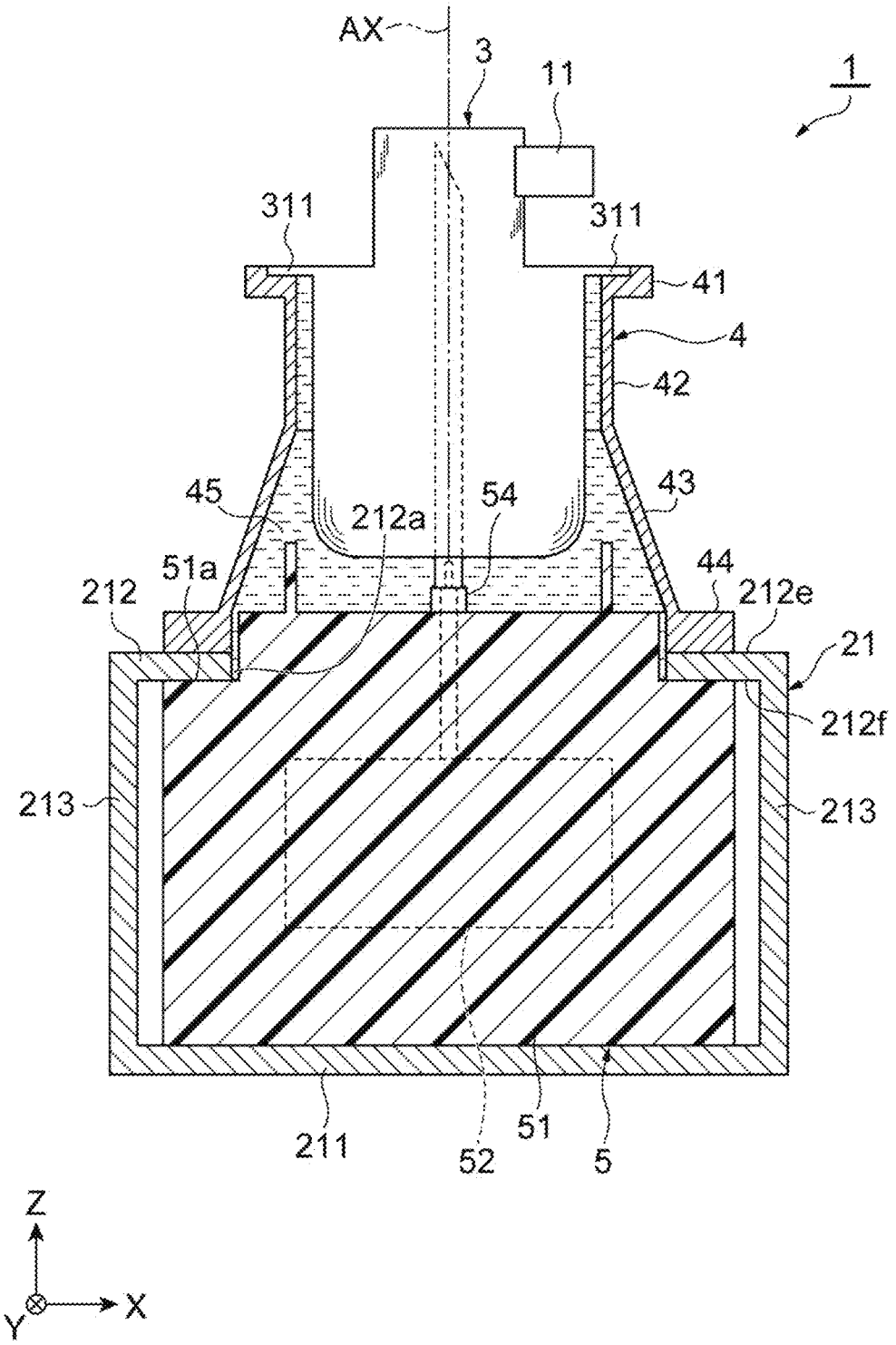
FIG. 2 is a cross-sectional view of the X-ray generation device taken along line II-II illustrated in FIG. 1.

FIG. 1 is a perspective view illustrating the appearance of an X-ray generation device. The X-ray generation device includes the X-ray tube according to the embodiment of the present invention. FIG. 2 is a cross-sectional view taken along line II-II illustrated in FIG. 1. An X-ray generation device 1 illustrated in FIGS. 1 and 2 is a micro-focus X-ray source. For example, the micro-focus X-ray source is used in an X-ray non-destructive test in which the internal structure of a test subject is observed. The X-ray generation device 1 has a housing 2. An X-ray tube 3 and a power source unit 5 are accommodated inside the housing 2. The X-ray tube 3 generates X-rays. The power source unit 5 supplies electric power to the X-ray tube 3. The housing 2 has an X-ray tube accommodation portion 4 and an accommodation portion 21. The X-ray tube accommodation portion 4 accommodates a part of the X-ray tube 3.

The accommodation portion 21 accommodates the power source unit 5. The accommodation portion 21 has a bottom wall portion 211, an upper wall portion 212, and side wall portions 213. Each of the bottom wall portion 211 and the upper wall portion 212 has a substantially square shape. Edge portions of the bottom wall portion 211 are coupled to edge portions of the upper wall portion 212 with four side wall portions 213 interposed therebetween. The accommodation portion 21 has a substantially parallelepiped shape. In the present embodiment, for the sake of convenience, a direction in which the bottom wall portion 211 and the upper wall portion 212 oppose each other will be defined as a Z-direction. The bottom wall portion 211 side will be defined as below. The upper wall portion 212 side will be defined as above. Directions in which the side wall portions 213 orthogonal to the Z-direction and opposing each other oppose each other will be defined as an X-direction and a Y-direction. An opening portion 212*a* is provided in a middle portion of the upper wall portion 212 when viewed in the Z-direction. The opening portion 212*a* is a circular penetration hole.

The X-ray tube accommodation portion 4 is formed of a metal having a high thermal conductivity. That is, the X-ray tube accommodation portion 4 is formed of a metal of high heat dissipation. Examples of a material for the X-ray tube accommodation portion 4 include aluminum, iron, copper, and an alloy including thereof. In the present embodiment, a material for the X-ray tube accommodation portion 4 is aluminum or an aluminum alloy. The X-ray tube accommodation portion 4 has a tubular shape. The X-ray tube accommodation portion 4 has openings provided at both ends of the X-ray tube 3 in a tube axis direction (Z-direction). A tube axis of the X-ray tube accommodation portion 4 coincides with a tube axis AX of the X-ray tube 3. The X-ray tube accommodation portion 4 has a holding portion 41, a cylinder portion 42, a tapered portion 43, and a flange portion 44. The holding portion 41 holds the X-ray tube 3 in a flange portion 311 by using a fixing member (not illustrated). The holding portion 41 and the X-ray tube 3 seal an upper opening of the X-ray tube accommodation portion 4 in an air-tight manner. The cylinder portion 42 is connected to a lower end of the holding portion 41. The cylinder portion 42 has a cylindrical shape. The cylinder portion 42 includes a wall surface extending in the Z-direction. The tapered portion 43 is connected to an end portion of the cylinder portion 42. The tapered portion 43 includes the wall surface. This wall surface is continuously and gently increased in diameter while being away from the cylinder portion 42 in the Z-direction from the end portion of the cylinder portion 42. The cylinder portion 42 is connected to the tapered portion 43. The wall surface of the cylinder portion 42 and the wall surface of the tapered portion 43 have planar shapes. In cross sections at a ZX-plane and a ZY plane, an angle formed by the wall surface of the cylinder portion 42 and the wall surface of the tapered portion 43 is an obtuse angle. The flange portion 44 is connected to the end portion of the tapered portion 43. The flange portion 44 extends outward when viewed in the Z-direction. The flange portion 44 has a ring shape. The thickness of the flange portion 44 is larger than the thicknesses of the cylinder portion 42 and the tapered portion 43. According to this configuration, the heat capacity of the flange portion 44 increases. As a result, heat dissipation of the flange portion 44 is improved. When viewed in the Z-direction, the flange portion 44 is fixed to an upper surface 212*e* of the upper wall portion 212 at a position surrounding the opening portion 212*a* of the upper wall portion 212. The connection portion between the flange portion 44 and the upper surface 212*e* of the upper wall portion 212 is in an air-tight state. In the present embodiment, the flange portion 44 is thermally connected to the upper surface 212*e* of the upper wall portion 212. In other words, the flange portion 44 can conduct heat to the upper surface 212*e* of the upper wall portion 212. An insulating oil 45 is sealed inside (fills the inside of) the X-ray tube accommodation portion 4 in an air-tight manner. The insulating oil 45 is an electrically insulating liquid.

The power source unit 5 supplies electric power within a range of approximately several kV to several hundreds of kV to the X-ray tube 3. The power source unit 5 has an insulating block 51 and an internal substrate 52. The insulating block 51 is formed of a solid epoxy resin. The insulating block 51 has electrical insulating properties. The internal substrate 52 includes a high-voltage generation circuit. The high-voltage generation circuit is built inside the insulating block 51. The insulating block 51 has a substantially parallelepiped shape. An upper surface middle portion of the insulating block 51 penetrates the opening portion 212*a* of the upper wall portion 212. The upper surface middle portion of the insulating block 51 protrudes from the opening portion 212*a*. An upper surface edge portion 51*a* of the insulating block 51 is fixed to a lower surface 212*f* of the upper wall portion 212. The connection portion between the upper surface edge portion 51*a* of the insulating block 51 and the lower surface 212*f* of the upper wall portion 212 is in an air-tight state. A high-voltage power supply portion 54 is disposed in the upper surface middle portion of the insulating block 51. The high-voltage power supply portion 54 includes a socket. The socket has a cylindrical shape. The socket is electrically connected to the internal substrate 52. The power source unit 5 is electrically connected to the X-ray tube 3 with the high-voltage power supply portion 54 interposed therebetween.

A part of the insulating block 51 is inserted through the opening portion 212*a*. The part of the insulating block 51 inserted through the opening portion 212*a* is the upper surface middle portion. The outer diameter of the upper surface middle portion is the same as the inner diameter of the opening portion 212*a*. The outer diameter of the upper surface middle portion may be slightly smaller than the inner diameter of the opening portion 212*a*.

Figure 3:
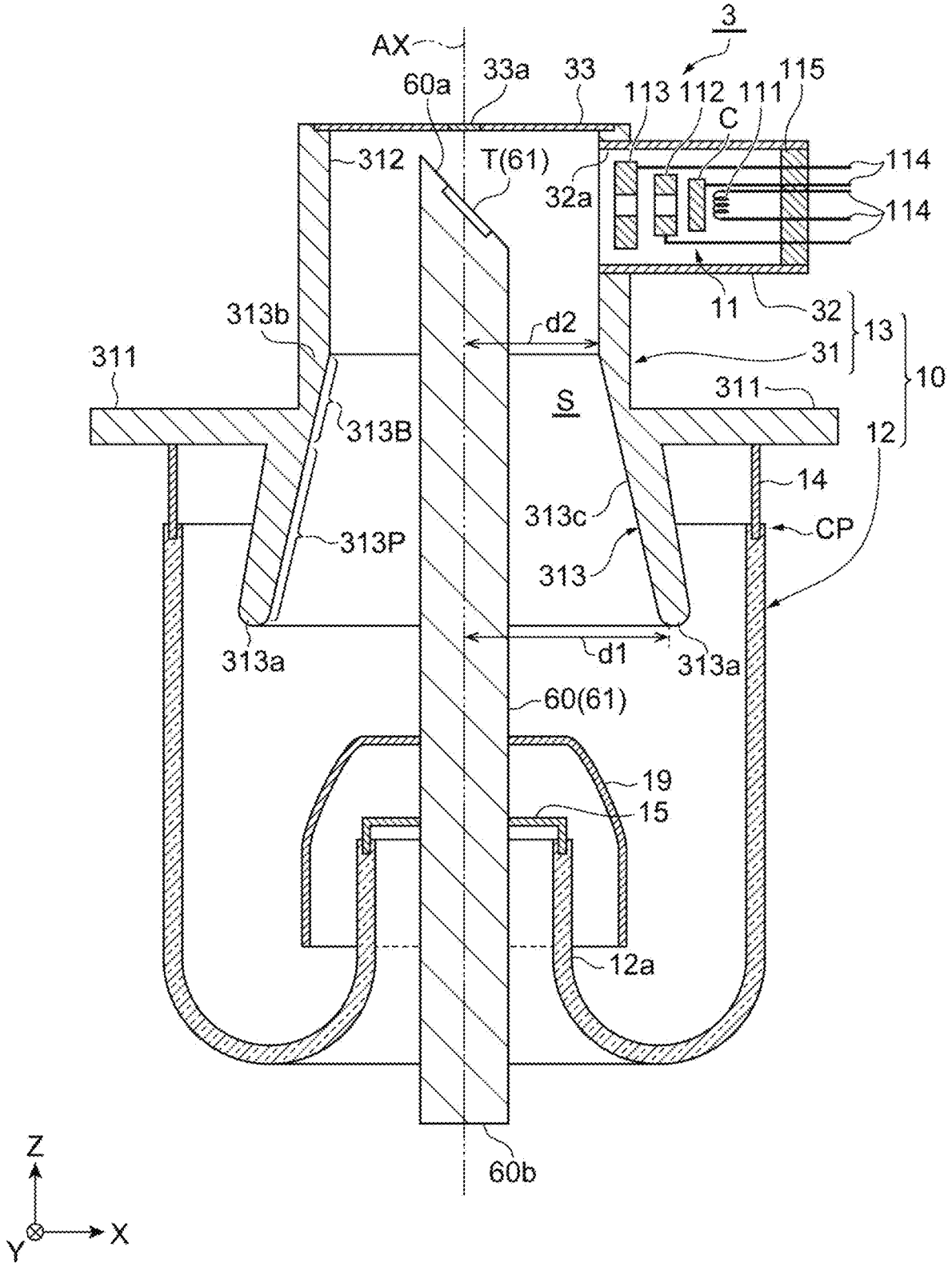
FIG. 3 is a cross-sectional view illustrating a configuration of an X-ray tube.

A configuration of the X-ray tube 3 will be described. As illustrated in FIG. 3, the X-ray tube 3 is a so-called reflective X-ray tube. The X-ray tube 3 includes a vacuum housing 10, an electron gun 11, and a target T. The vacuum housing 10 is a vacuum envelope internally maintaining a vacuum state. The electron gun 11 is an electron generation unit. The electron gun 11 has a cathode C. For example, the cathode C has a base body which is formed of a high melting-point metal material or the like and a substance which has been impregnated in the base body and easily emits electrons. The target T has a plate shape. For example, the target T is formed of a high melting-point metal material such as tungsten. A position at the center of the target T overlaps the tube axis AX of the X-ray tube 3. The electron gun 11 and the target T are accommodated inside the vacuum housing 10. Electrons emitted from the electron gun 11 are incident on the target T. As a result, the target T generates X-rays. The generated X-rays are radiated outside through an X-ray emission window 33*a*.

The vacuum housing 10 has an insulation valve 12 (valve portion) and a metal portion 13. The insulation valve 12 is formed of an insulating material. Examples of an insulating material include glass. The metal portion 13 has the X-ray emission window 33*a*. The vacuum housing 10 has an inner space S. The metal portion 13 has a main body portion 31 and an electron gun accommodation portion 32. The main body portion 31 accommodates the target T. The electron gun accommodation portion 32 accommodates the electron gun 11 serving as a cathode.

The main body portion 31 has a tubular shape. A lid plate 33 is fixed to one end portion (outer end portion) of the main body portion 31. The lid plate 33 has the X-ray emission window 33*a*. The material of the X-ray emission window 33*a* is an X-ray transmission material. Examples of an X-ray transmission material include beryllium and aluminum. The lid plate 33 closes one end side of the inner space S. The main body portion 31 has the flange portion 311, a cylinder portion 312, and a tapered portion 313. The flange portion 311 is provided in the outer circumference of the main body portion 31. The flange portion 311 is fixed to the Holding portion 41 of the X-ray tube accommodation portion 4 described above. The cylinder portion 312 is formed on one end portion side of the main body portion 31. The cylinder portion 312 has a cylindrical shape. The tapered portion 313 is connected to the other end portion of the cylinder portion 312. The tapered portion 313 is increased in diameter while being away from the cylinder portion 312 in the tube axis direction (Z-direction) of the X-ray tube 3. The tapered portion 313 protrudes into the inner space S. The tapered portion 313 blocks the connection portion between the insulation valve 12 and a ring member 14 from a target supporting portion 60.

The electron gun accommodation portion 32 has a cylindrical shape. The electron gun accommodation portion 32 is fixed to a side portion of the main body portion 31 on one end portion side. The center axis line of the main body portion 31 is substantially orthogonal to the center axis line of the electron gun accommodation portion 32. In other words, the tube axis AX of the X-ray tube 3 is substantially orthogonal to the center axis line of the electron gun accommodation portion 32. An opening 32*a* is provided in an end portion of the electron gun accommodation portion 32 on the main body portion 31 side. The inside of the electron gun accommodation portion 32 communicates with the inner space S of the main body portion 31 through the opening 32*a*.

The electron gun 11 includes the cathode C, a heater 111, a first grid electrode 112, and a second grid electrode 113. In the electron gun 11, the beam diameter of an electron beam generated in cooperation with the constituent components can be reduced. In other words, the electron gun 11 can perform micro-focusing of an electron beam. The cathode C, the heater 111, the first grid electrode 112, and the second grid electrode 113 are attached to a stem substrate 115 with a plurality of power feeding pins 114 interposed therebetween. The plurality of power feeding pins 114 extend in a manner of being parallel to each other. The cathode C, the heater 111, the first grid electrode 112, and the second grid electrode 113 receive electric power from the outside with the corresponding power feeding pins 114 interposed therebetween.

The insulation valve 12 has a substantially tubular shape. The ring member 14 is fused into one end portion of the insulation valve 12. The ring member 14 is formed of a metal or the like. The ring member 14 is joined to the main body portion 31. Due to this joining, one end side of the insulation valve 12 is connected to the main body portion 31 with the ring member 14 interposed therebetween. An inner cylinder portion 12*a* is provided on the other end side of the insulation valve 12. The inner cylinder portion 12*a* extends to the inner side of the insulation valve 12. In addition, the inner cylinder portion 12*a* has a cylindrical shape. The other end portion of the insulation valve 12 is folded back to the inner side throughout the whole circumference, such that a hole portion is defined in a middle portion of the insulation valve 12 when viewed in the Z-direction.

The inner cylinder portion 12*a* of the insulation valve 12 holds an anode 61 (target supporting portion 60) with a fixing portion 15 interposed therebetween. The target supporting portion 60 has a rod shape. In addition, the target supporting portion 60 has a columnar shape. For example, the target supporting portion 60 is formed of a copper material or the like. The target supporting portion 60 extends in the Z-direction. An inclined surface 60*a* is formed at the distal end of the target supporting portion 60. The inclined surface 60*a* is inclined away from the electron gun 11 while going from the insulation valve 12 side toward the main body portion 31 side. The target T is buried in an end portion of the target supporting portion 60. The target T is flush with the inclined surface 60*a*.

A base end portion 60*b* of the target supporting portion 60 protrudes outward beyond a lower end portion of the insulation valve 12. In other words, the base end portion 60*b* of the anode 61 protrudes outward beyond a folded-back position. The base end portion 60*b* of the target supporting portion 60 (anode 61) is connected to the high-voltage power supply portion 54 of the power source unit 5 (refer to FIG. 2). In the present embodiment, the vacuum housing 10 has the ground potential. Therefore, the metal portion 13 has the ground potential. The anode 61 (target supporting portion 60) receives a high positive voltage from the high-voltage power supply portion 54. The anode 61 may receive a voltage from a power source in a form different from a high positive voltage.

The fixing portion 15 is formed of a metal or the like. The fixing portion 15 is a member for fixing the target supporting portion 60 to the other end portion of the insulation valve 12 (upper end portion of the inner cylinder portion 12*a*). One end side of the fixing portion 15 is fixed to the target supporting portion 60. The other end side of the fixing portion 15 is fused into the end portion of the inner cylinder portion 12*a*. Due to these structures, the target supporting portion 60 (anode 61) is fixed to extend along the tube axis AX. In other words, the axis line of the target supporting portion 60 (anode 61) is coaxial with the tube axis AX. In addition, the connection portion between the target supporting portion 60 and the insulation valve 12 is vacuum-sealed.

A cover electrode 19 is an electrode member. The cover electrode 19 surrounds a fused part (joint part) between the inner cylinder portion 12*a* of the insulation valve 12 and the fixing portion 15 from the outside. In the cover electrode 19, the distal end portion having a substantially truncated cone shape and the base end portion having a cylindrical shape are smoothly connected to each other. The distal end portion is fixed to the target supporting portion 60. Due to this structure, the cover electrode 19 is formed to have a substantially cylindrical shape. Electric discharge is likely to occur particularly in the foregoing fused part. The cover electrode 19 prevents damage to the insulation valve 12 caused by electric discharge.

[Operational Effects]

Operational effects of the X-ray tube 3 according to the aspect of the present embodiment will be described. The X-ray tube 3 includes the electron gun 11 that emits electrons, the target T that generates X-rays when electrons emitted from the electron gun 11 are incident on the target T, and the vacuum housing 10 that accommodates the electron gun 11 and the target T. The vacuum housing 10 has the metal portion 13 which has the X-ray emission window 33*a* emitting X-rays to the outside, and the insulation valve 12 which is formed of an insulating material (for example, glass) and is connected to the metal portion 13. The expression "connected to the metal portion 13" includes a state of being directly connected to the metal portion 13. Moreover, the expression "connected to the metal portion 13" includes a state of being indirectly connected thereto with an interposition member (ring member 14) interposed therebetween, as in the present embodiment.

The metal portion 13 has the cylinder portion 312 (first part) in which the X-ray emission window 33*a* is provided and which surrounds the tube axis AX (central axis) of the vacuum housing 10, and the tapered portion 313 (second part) which is connected to the end portion of the cylinder portion 312 on the insulation valve 12 side, surrounds the tube axis AX, and protrudes such that the connection part between the metal portion 13 and the insulation valve 12 is covered. Here, "a connection part CP between the metal portion 13 and the insulation valve 12" is a boundary between a metal (conductive material) and an electrical insulator (insulating material). In the present embodiment, the connection part CP corresponds to the connection portion between the insulation valve 12 and the ring member 14. When the metal portion 13 and the insulation valve 12 are directly connected to each other, the connection part CP corresponds to the connection portion between the metal portion 13 and the insulation valve 12. The case in which the metal portion 13 and the insulation valve 12 are directly connected to each other includes a case in which the metal portion 13 and the ring member 14 of the present embodiment are integrated. The expression "the connection part between the metal portion 13 and the insulation valve 12 is covered" indicates that the connection part between the metal portion 13 and the insulation valve 12 is blocked from being directly viewed from at least the anode 61 (target supporting portion 60) accommodated in the inner space S of the vacuum housing 10.

The tapered portion 313 is increased in inner diameter such that a separation distance d1 is larger than a separation distance d2. The separation distance d1 is a length from a distal end portion 313*a* of the tapered portion 313 to the tube axis AX. The distal end portion 313*a* of the tapered portion 313 is an end portion on a side opposite to a base end portion 313*b* connected to the cylinder portion 312. In addition, the separation distance d2 is a length from the base end portion 313*b* to the tube axis AX. The tapered portion 313 includes a tapered portion 313P and a base portion 313B. The tapered portion 313P has the distal end portion 313*a*. The tapered portion 313P entirely protrudes into the inner space S of the vacuum housing 10. The tapered portion 313P has a toric shape. The inner wall surface of the tapered portion 313P opposes the anode 61 (target supporting portion 60) throughout the whole circumference. The inner wall surface of the tapered portion 313P surrounds the anode 61 (target supporting portion 60) throughout the whole circumference.

The whole circumference of an outer wall surface of the tapered portion 313P opposes the connection part CP. The whole circumference of the outer wall surface of the tapered portion 313P covers the connection part CP. The base portion 313B has the base end portion 313*b*. The whole circumference of the inner wall surface of the base portion 313B opposes the anode 61 (target supporting portion 60). The whole circumference of the inner wall surface of the base portion 313B surrounds the anode 61. The base portion 313B has a toric shape. At least a part of the outer surface of the base portion 313B is exposed to the outside of the inner space S. The inner wall surfaces of the tapered portion 313P and the base portion 313B are increased in diameter. According to this shape, the separation distance d1 from the distal end portion 313*a* to the tube axis AX becomes larger than the separation distance d2 from the base end portion 313*b* to the tube axis AX. An inner wall surface 313*c* of the tapered portion 313 includes the inner wall surface of the tapered portion 313P and the inner wall surface of the base portion 313B. The front surface of the distal end portion 313*a* has an arc shape of which corner portions are chamfered. According to this shape, electric discharge occurring in the corner portions is curbed.

The tapered portion 313 of the X-ray tube 3 protrudes such that the connection part CP is covered. The connection part CP is a part in which the metal portion 13 and the insulation valve 12 are connected to each other. The connection part CP is a boundary part between a metal and an insulator. The connection part CP is a part in which electric discharge is likely to occur. The tapered portion 313 curbs electric discharge occurring in the connection part CP. The distal end portion 313*a* of the tapered portion 313 is further separated from the tube axis AX than the base end portion 313*b*. In this manner, the shape which is increased in diameter such that the distal end portion 313*a* is further separated from the tube axis AX than the base end portion 313*b* will be simply referred to as "a diameter increasing shape". Compared to the case of employing no diameter increasing shape, the X-ray tube 3 employing a diameter increasing shape can cause the distal end portion 313*a* of the tapered portion 313 to be away from a member disposed in the tube axis AX of the X-ray tube 3. A member disposed in the tube axis AX of the X-ray tube 3 is a member having an electrical polarity opposite to that of the metal portion 13. The member is the anode 61 (target supporting portion 60) to which a high voltage is applied. The X-ray tube 3 employing a diameter increasing shape alleviates a concentration of an electric field generated in the distal end portion 313*a*. Therefore, the X-ray tube 3 can curb electric discharge occurring in the distal end portion 313*a*. The X-ray tube 3 can effectively curb electric discharge occurring in the vacuum housing 10.

As illustrated in FIG. 3, the tapered portion 313 has the tapered portion 313P and the base portion 313B. The tapered portion 313P has the distal end portion 313*a*. The tapered portion 313P entirely protrudes into the inner space S of the vacuum housing 10. The base portion 313B has the base end portion 313*b*. At least a part of the outer surface of the base portion 313B is exposed to the outside. The inner wall surfaces of the tapered portion 313P and the base portion 313B are increased in diameter such that the separation distance d1 between the distal end portion 313*a* and the tube axis AX is larger than the separation distance d2 between the base end portion 313*b* and the tube axis AX. Accordingly, an angle formed by the inner wall surface of the cylinder portion 312 and the inner wall surface of the tapered portion 313 becomes moderate. As a result, it is possible to reduce a possibility of electric discharge which may occur in the connection portion between the cylinder portion 312 and the tapered portion 313. In more details, if the tapered portion 313 is constituted of only the tapered portion 313P, there is a need to widen the angle for diameter increasing, in order to obtain the same separation distance d1. The angle for diameter increasing is an inclination angle with respect to the tube axis AX. Alternatively, there is a need to extend the overall length of the tapered portion 313P, in order to obtain the same separation distance d1. When the angle for diameter increasing is widened, an angle formed by the inner wall surface of the cylinder portion 312 and the inner wall surface of the tapered portion 313 is widened. As a result, there is a high possibility of electric discharge occurring in the connection portion between the cylinder portion 312 and the tapered portion 313. On the other hand, when the overall length of the tapered portion 313P is extended, the distance from a member such as the cover electrode 19 having a potential different from that of the tapered portion 313P to the tapered portion 313P is shortened. As a result, there is a high possibility of electric discharge. In contrast, the base portion 313B is provided in the X-ray tube 3. Moreover, the inner wall surface of the base portion 313B is caused to have a diameter increasing shape. As a result, the possibility of electric discharge can be reduced. In addition, the inclination angle of the inner wall surface 313*c* of the tapered portion 313 with respect to the tube axis AX is substantially equivalent to the inclination angle of the tapered portion 43 of the X-ray tube accommodation portion 4 with respect to the tube axis AX. A virtual plane along the inner wall surface 313*c* of the tapered portion 313 is substantially parallel to a virtual plane along the tapered portion 43 of the X-ray tube accommodation portion 4. As a result, it is possible to curb an influence of the externally disposed X-ray tube accommodation portion 4 on an electric field in the inner space S formed by the tapered portion 313.

As illustrated in FIG. 3, the inner wall surface 313*c* of the tapered portion 313 has a tapered shape. In other words, the separation distance between the inner wall surface 313*c* and the tube axis AX increases linearly while going from the base end portion 313*b* toward the distal end portion 313*a*. The inner wall surface 313*c* having such a shape is relatively easy to be worked. Therefore, it is possible to realize the diameter increasing shape described above. The inner wall surface 313*c* is smooth. Therefore, it is possible to reduce a possibility of electric discharge occurring on the inner wall surface 313*c*.

The anode 61 (target supporting portion 60) having the target T of the X-ray tube 3 is disposed while extending along the tube axis AX. Even if the X-ray tube 3 is employed in a so-called reflective X-ray tube, the X-ray tube 3 exhibits the effects described above. The tapered portion 313 has the diameter increasing shape described above. That is, compared to when the tapered portion 313 does not have the diameter increasing shape described above, in the X-ray tube 3, the separation distance from the anode 61 (target supporting portion 60) having a high potential to the distal end portion of the metal portion 13 (distal end portion 313*a* of the tapered portion 313) having a low potential (ground potential) increases. Therefore, the separation distance between the anode 61 (target supporting portion 60) and the distal end portion 313*a* is short. As a result, a concentration of an electric field generated in the distal end portion 313*a* is curbed. That is, electric discharge occurring in the distal end portion 313*a* is effectively curbed. The anode 61 (target supporting portion 60) may have the ground potential. A negative voltage may be supplied to the metal portion 13. A negative voltage is a voltage lower than that of the ground potential.

Figure 4:
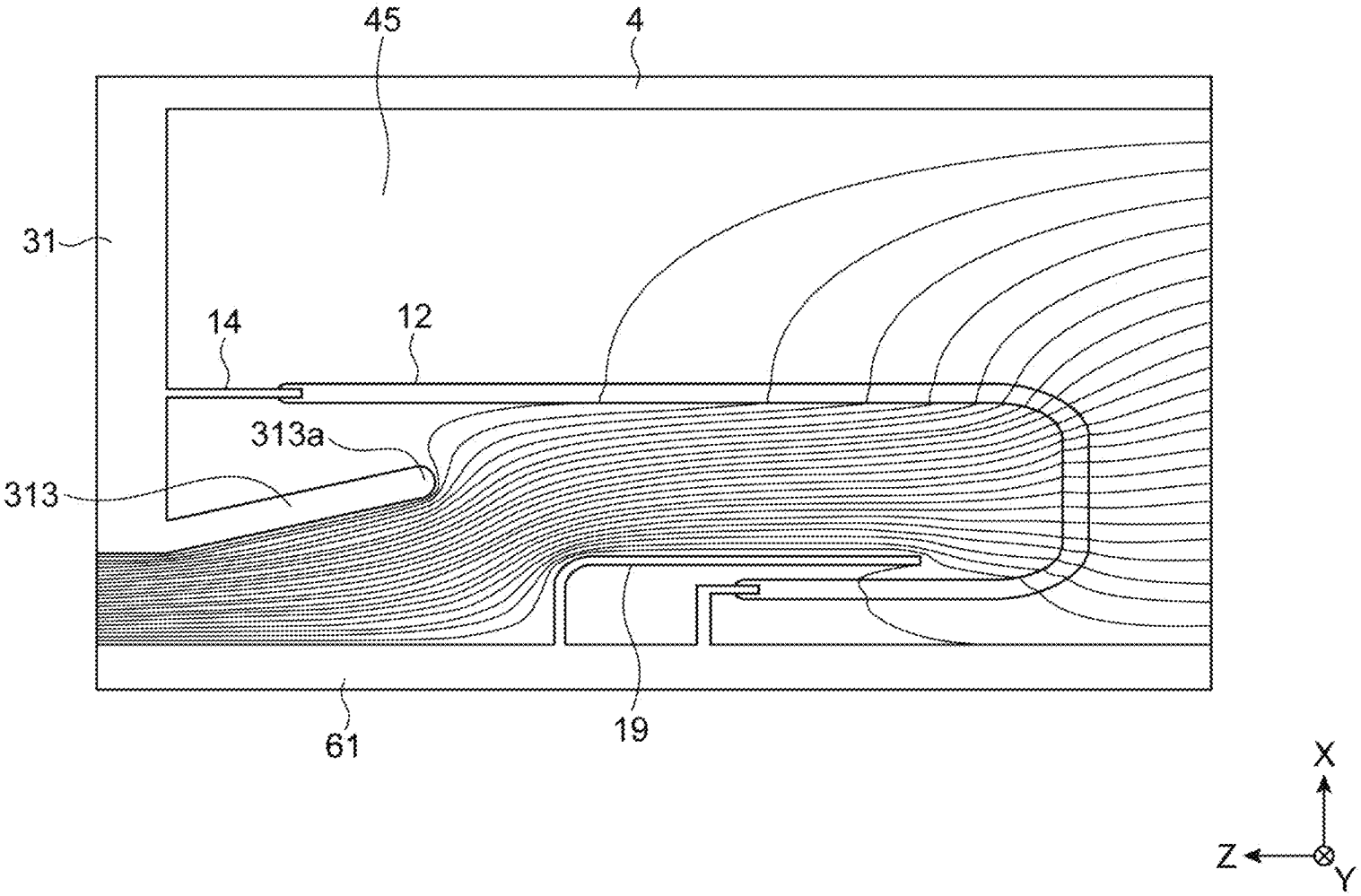
FIG. 4 is a view illustrating results of electric field analysis of an X-ray tube according to Example.

With reference to results (simulation results) of electric field analysis illustrated in FIGS. 4 and 5, effects of alleviating an electric field according to the foregoing embodiment will be described. FIG. 4 illustrates results of electric field analysis of an X-ray tube according to Example. In order to simplify description and analysis, each of the configurations of the X-ray tube according to Example illustrated in FIG. 4 is simplified within a range in which the effects of the tapered portion 313 are sufficiently exhibited. In this analysis, regarding analysis conditions, the vacuum housing (main body portion 31) has the ground potential. In addition, regarding the analysis conditions, a voltage of 100 kV is applied to the anode 61. FIG. 4 illustrates equipotential lines connecting positions having potentials equal to each other. A high voltage is applied to the anode 61. Therefore, the potential becomes higher while being closer to the anode 61 and the cover electrode 19. On the other hand, the potential becomes lower while being closer to an outer cylinder part of the tapered portion 313 and the insulation valve 12.

Figure 5:
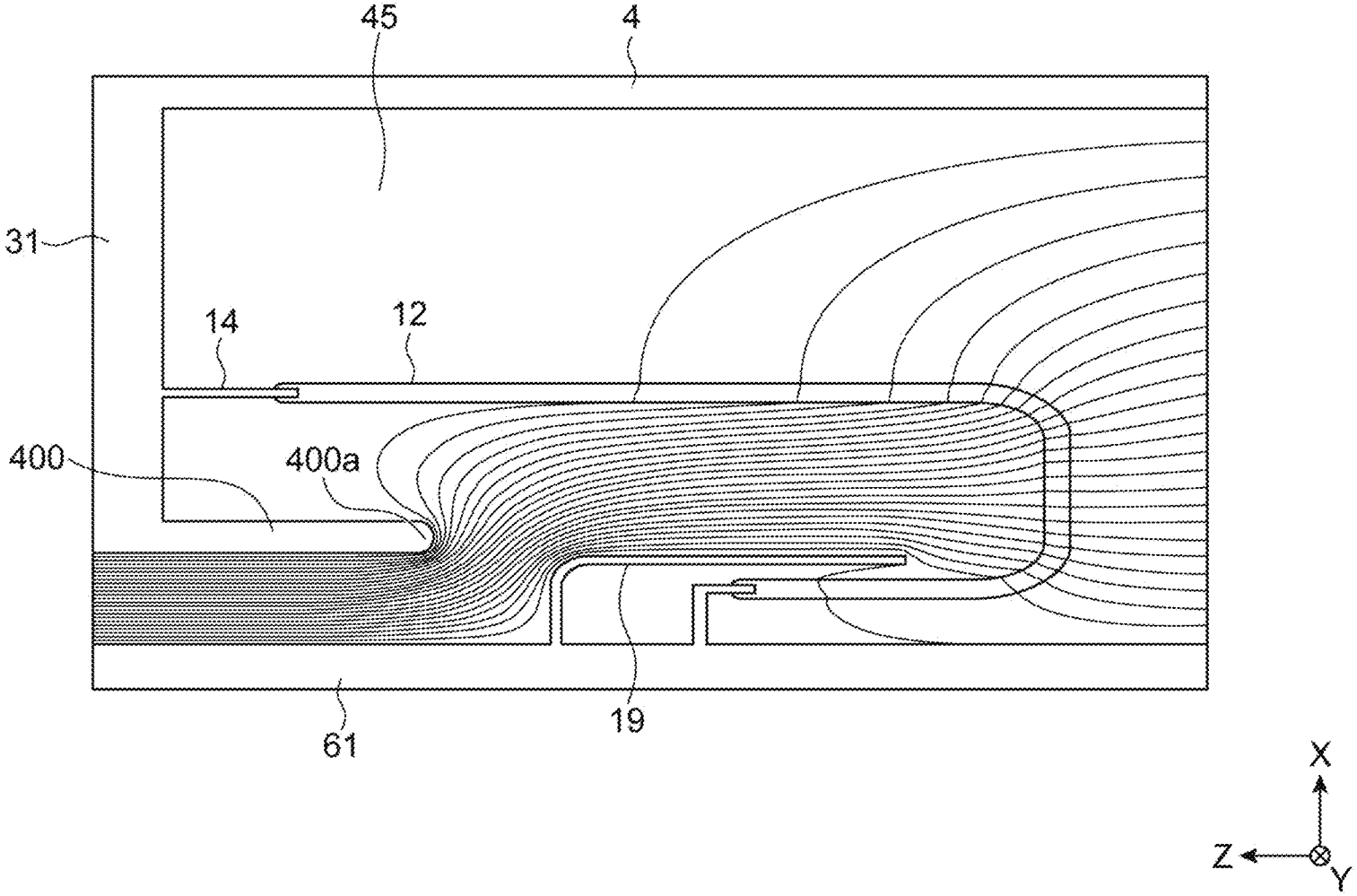
FIG. 5 is a view illustrating results of electric field analysis of an X-ray tube according to a comparative example.

FIG. 5 illustrates results of electric field analysis of an X-ray tube according to a comparative example. The X-ray tube according to the comparative example illustrated in FIG. 5 is an X-ray tube having a structure in the related art. In the X-ray tube according to the comparative example, a part covering the connection part between the insulation valve 12 and the main body portion 31 (metal portion 13) is a cylinder portion 400. The connection part between the insulation valve 12 and the main body portion 31 (metal portion 13) is a connection portion between the ring member 14 and the insulation valve 12. The inner diameter of the cylinder portion 400 is the same as the inner diameter of the cylinder portion 312. The analysis conditions are the same as those in the foregoing Example. In addition, FIG. 5 illustrates equipotential lines similar to those in FIG. 4.

The X-ray tube according to the comparative example has no diameter increasing shape. In the X-ray tube according to the comparative example, the separation distance from a distal end portion 400*a* of the cylinder portion 400 to the anode 61 is short. Moreover, in the X-ray tube according to the comparative example, the separation distance from the distal end portion 400*a* of the cylinder portion 400 to the cover electrode 19 is also short. As a result, as illustrated in FIG. 5, an electric field was concentrated in the distal end portion 400*a*. Specifically, it could be confirmed that the density of the equipotential lines generated in the distal end portion 400*a* was relatively high. It could be confirmed that the gradient of a potential (that is, the electric field) was relatively significant near the distal end portion 400*a*. In contrast, the X-ray tube according to Example has the diameter increasing shape (tapered shape) described above. In the X-ray tube according to Example, compared to the X-ray tube according to the comparative example, the separation distance from the distal end portion 313*a* of the tapered portion 313 to the anode 61 is long. Similarly, in the X-ray tube according to Example, the separation distance from the distal end portion 313*a* of the tapered portion 313 to the cover electrode 19 is also long. As a result, as illustrated in FIG. 4, it could be confirmed that a concentration of an electric field generated in the distal end portion 313*a* was alleviated. Specifically, it could be confirmed that the density of the equipotential lines generated in the distal end portion 313*a* was lower than that in the comparative example. That is, it could be confirmed that the gradient of a potential (electric field) generated near the distal end portion 313*a* was smaller than that of an electric field generated near the distal end portion 400*a*. According to the foregoing analysis results, it could be confirmed that the tapered portion 313 having a diameter increasing shape could effectively curb a concentration of an electric field generated in the distal end portion 313*a*.

Hereinabove, the embodiment of the present invention has been described. The present invention is not limited to the foregoing embodiment. The present invention can be variously modified within a range not departing from the gist thereof. That is, the shape, the material, and the like of each of the units in the X-ray generation device are not limited to the shapes, the materials, and the like specified in the foregoing embodiment.

First Modification Example

Figure 6A:
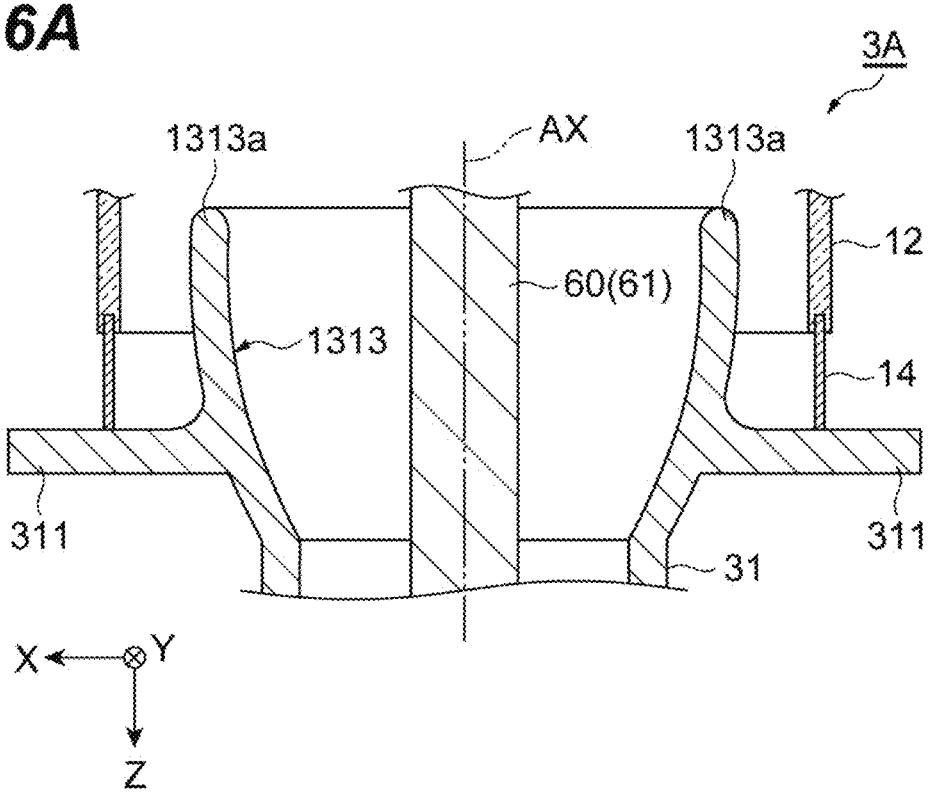
FIG. 6A is a cross-sectional view illustrating a main portion of an X-ray tube according to a first modification example.

FIG. 6A is a cross-sectional view illustrating a main portion of an X-ray tube 3A according to a first modification example. The X-ray tube 3A is different from the X-ray tube 3 in regard to having a diameter increasing portion 1313 (second part) in place of the tapered portion 313. The diameter increasing portion 1313 has a curved cross-sectional shape (curved shape). In the diameter increasing portion 1313, the separation distance from the inner wall surface of the diameter increasing portion 1313 to the tube axis AX increases continuously from the base end side to the distal end side (distal end portion 1313*a* side) of the diameter increasing portion 1313. The variation range of the separation distance per unit distance along the tube axis AX is gradually reduced toward the distal end portion 1313*a* side. As a result, the diameter increasing portion 1313 has a curved shape (R shape) projected outward. The diameter increasing portion 1313 exhibits effects similar to those in the case of including the tapered portion 313 of the foregoing embodiment. In the diameter increasing portion 1313, even on the inner wall surface other than the distal end portion 1313*a*, the separation distance to the anode 61 (target supporting portion 60) is relatively long. Therefore, the X-ray tube 3A can further reduce the possibility of electric discharge.

Second Modification Example

Figure 6B:
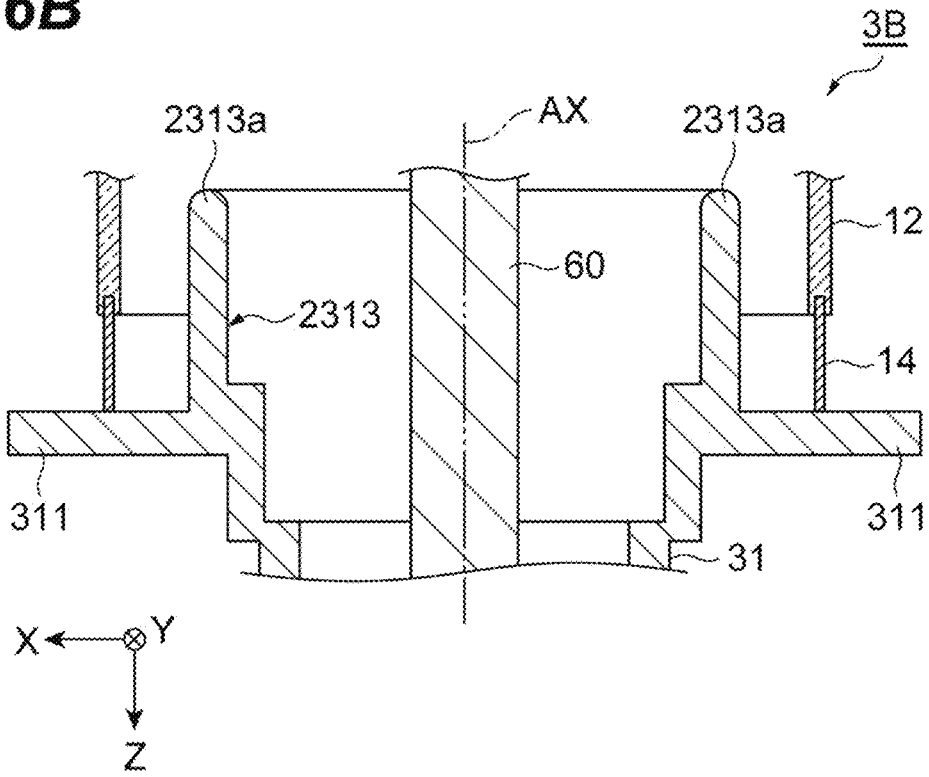
FIG. 6B is a cross-sectional view illustrating a main portion of an X-ray tube according to a second modification example.

FIG. 6B is a cross-sectional view illustrating a main portion of an X-ray tube 3B according to a second modification example. The X-ray tube 3B is different from the X-ray tube 3 in regard to having a diameter increasing portion 2313 (second part) in place of the tapered portion 313. The diameter increasing portion 2313 has a cross-sectional shape in which the diameter increases step by step (stepped shape). In the diameter increasing portion 2313, the separation distance from the inner wall surface of the diameter increasing portion 2313 to the tube axis AX increases step by step from the base end side toward the distal end side (distal end portion 2313*a* side) of the diameter increasing portion 2313. The expression "step by step" may be substituted with "intermittently" or "discontinuously". The diameter increasing portion 2313 exhibits effects similar to those in the case of including the tapered portion 313 of the foregoing embodiment. The diameter increasing portion 2313 is easy to be worked.

Third Modification Example

Figure 7:
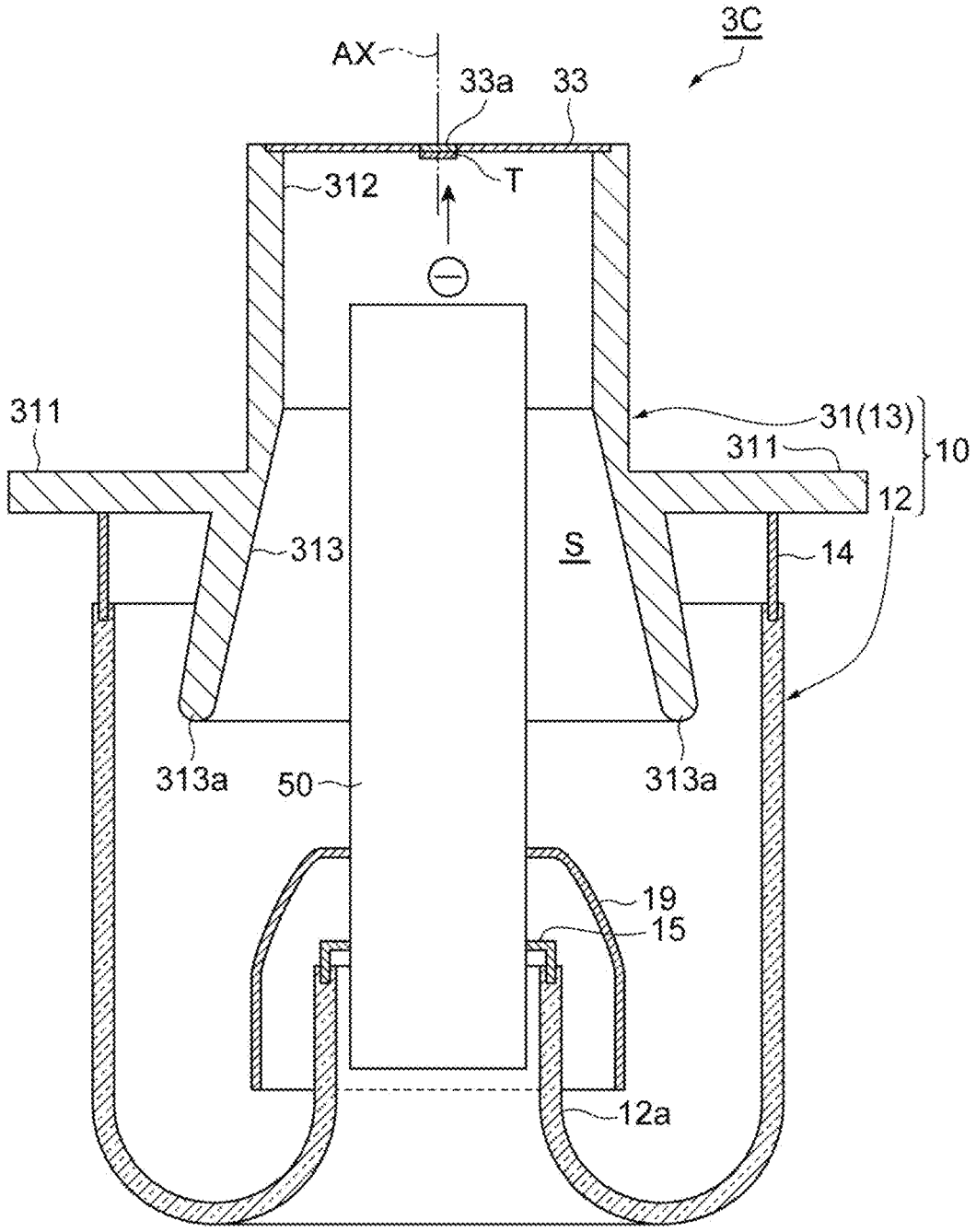
FIG. 7 is a cross-sectional view illustrating a configuration of an X-ray tube according to a third modification example.
Figure 7:
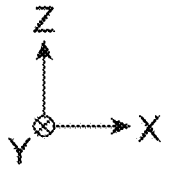

FIG. 7 is a cross-sectional view of an X-ray tube 3C according to a third modification example. As illustrated in FIG. 7, the X-ray tube 3C is different from the X-ray tube 3 in which the anode 61 (target supporting portion 60) is disposed on the tube axis AX, in regard to having an electron gun accommodation portion 50 disposed on the tube axis AX. The X-ray tube 3C is an X-ray tube of a so-called transmission type. Therefore, the X-ray tube 3C is different from the X-ray tube 3 of a so-called reflective type. Specifically, similar to the X-ray tube 3, the X-ray emission window 33*a* of the X-ray tube 3C is provided in the lid plate 33. The X-ray emission window 33*a* intersects the tube axis AX. The lid plate 33 is fixed to the upper end portion of the cylinder portion 312. The upper end portion of the cylinder portion 312 is an end portion on a side opposite to the tapered portion 313 side. The target T of the X-ray tube 3C is provided on the inner side of the X-ray emission window 33*a*. The X-ray tube 3C generates X-rays when electrons are incident on a surface (lower surface illustrated in FIG. 7) on a side opposite to the X-ray emission window 33*a* of the target T. The X-ray tube 3C emits generated X-rays upward to the X-ray emission window 33*a*.

The internal configuration of the electron gun accommodation portion 50 (electron gun) is the same as the internal configuration of the electron gun accommodation portion 32 described above. The electron gun accommodation portion 50 (electron gun) has a cylindrical shape. The distal end side of the electron gun accommodation portion 50 extends along (coaxially with) the tube axis AX such that electrons are emitted toward the target T. The base end side of the electron gun accommodation portion 50 is connected to the insulation valve 12. Similar to the anode 61 (target supporting portion 60) of the X-ray tube 3, the electron gun accommodation portion 50 is connected to the end portion of the inner cylinder portion 12*a* of the insulation valve 12 with the fixing portion 15 interposed therebetween. The connection portion between the electron gun accommodation portion 50 and the inner cylinder portion 12*a* is surrounded by the cover electrode 19.

The vacuum housing 10 including the metal portion 13 has the same potential as the target T. For example, the target T and the vacuum housing 10 have the ground potential. A high negative voltage may be supplied to the electron gun. A high negative voltage is a voltage having an absolute value larger than that of the ground potential and having the negative polarity. The electron gun may have the ground potential. In this case, a high positive voltage may be supplied to the target T and the vacuum housing 10.

The electron gun (electron gun accommodation portion 50) of the X-ray tube 3C extends along the tube axis AX of the vacuum housing 10. According to such an X-ray tube 3C, it is possible to exhibit effects similar to those of the X-ray tube 3 according to the foregoing embodiment. The tapered portion 313 of the X-ray tube 3C has the diameter increasing shape described above. Therefore, compared to the case in which the tapered portion 313 does not have the diameter increasing shape described above, the X-ray tube 3C can have a long separation distance from the electron gun to the distal end portion of the metal portion 13. The electron gun has a low potential. This low potential means a potential having the negative polarity with respect to the ground potential. The potential of the metal portion 13 is the same as the potential of the target T. The target T has a high potential. That is, the metal portion 13 also has a high potential. This high potential is the ground potential, for example. According to this structure, the separation distance between the electron gun and the distal end portion 313*a* is short. As a result, a concentration of an electric field generated in the distal end portion 313*a* is curbed. Therefore, electric discharge occurring in the distal end portion 313*a* can be effectively curbed.

Other Modification Examples

In the reflective X-ray tubes 3, 3A, and 3B described above, the X-ray emission window 33*a* has been formed above the target T. In addition, the electron gun 11 has been disposed on the side of the target T. For example, a method of radiating X-rays may be a so-called side window method. The side window method indicates a method in which an X-ray emission window is provided on the side of the target T. Specifically, in an X-ray tube employing the side window method, an electron gun may be disposed at a position where the X-ray emission window 33*a* is provided. The position where the X-ray emission window 33*a* is provided is above the target T. The electron gun emits electrons downward to the target T in the tube axis direction (Z-direction). In addition, in an X-ray tube employing the side window method, an X-ray emission window may be disposed at a position where the electron gun 11 is provided. The position where the electron gun 11 is provided is a side of the target T.

The second part (the tapered portion 313, or the diameter increasing portions 1313 or 2313) in the foregoing embodiment and the modification examples protrudes such that the joint portion between the metal portion 13 and the insulation valve 12 is covered. Then, the second part is constituted of a part of the main body portion 31. For example, the second part may be constituted as a member independent from the main body portion 31.

What is claimed is:

1. An X-ray tube comprising:

an electron gun that emits electrons;

a target that generates X-rays when electrons emitted from the electron gun are incident on the target; and a vacuum housing that accommodates the electron gun and the target, wherein the vacuum housing has a metal portion which has an X-ray emission window emitting X-rays to the outside and a valve portion which is formed of an insulating material and is connected to the metal portion, wherein the metal portion has a first part in which the X-ray emission window is provided and which surrounds a central axis of the vacuum housing, and a second part which is connected to an end portion of the first part on the valve portion side, surrounds the central axis, and protrudes such that a connection part between the metal portion and the valve portion is covered, wherein the second part has a base end portion connected to the first part, and a distal end portion on a side opposite to the base end portion, wherein the second part has a shape that increases in diameter such that a first separation distance between the distal end portion and the central axis is longer than a second separation distance between the base end portion and the central axis, wherein the second part includes a covering part that is provided between the base end portion and the distal end portion, and which covers the connection part between the metal portion and the valve portion, and wherein a third separation distance between the covering part and the central axis is shorter than the first separation distance and longer than the second separation distance.

2. The X-ray tube according to claim 1, wherein the second part has a protrusion portion which has the distal end portion and of which the entirety protrudes into an inner space of the vacuum housing, and a base portion which has the base end portion and of which at least a part of an outer surface is exposed to the outside, and wherein inner wall surfaces of the protrusion portion and the base portion are increased in diameter such that the separation distance between the distal end portion and the central axis is longer than the separation distance between the base end portion and the central axis.

3. The X-ray tube according to claim 1, wherein an inner wall surface of the second part has a tapered shape in which a separation distance between the inner wall surface and the central axis increases linearly from the base end portion toward the distal end portion.

4. The X-ray tube according to claim 1, wherein an inner wall surface of the second part has a curved shape in which a separation distance between the inner wall surface and the central axis increases continuously from the base end portion toward the distal end portion.

5. The X-ray tube according to claim 1, wherein an inner wall surface of the second part has a stepped shape in which a separation distance between the inner wall surface and the central axis increases step by step from the base end portion toward the distal end portion.

6. The X-ray tube according to claim 1, wherein an anode having the target is disposed while extending along the central axis.

7. The X-ray tube according to claim 1, wherein the electron gun is disposed while extending along the central axis.

8. The X-ray tube according to claim 1, wherein the distal end portion of the second part extends in a direction along an inner wall surface of the covering part covering the connection part between the metal portion and the valve portion.

9. The X-ray tube according to claim 1, wherein the metal portion includes a flange portion, and wherein the base end portion of the second part is disposed more toward the X-ray emission window than the flange portion.

* * * * *